US006687953B1

(12) United States Patent
Liang

(10) Patent No.: US 6,687,953 B1
(45) Date of Patent: Feb. 10, 2004

(54) TORSION SPRING DOOR CHECK DEVICE

(75) Inventor: Chuan Liang, Scaborough (CA)

(73) Assignee: Ventra Group Inc., Bradford (CA)

( * ) Notice: Subject to any disclaimer, the term of this patent is extended or adjusted under 35 U.S.C. 154(b) by 269 days.

(21) Appl. No.: 09/689,853

(22) Filed: Oct. 13, 2000

(51) Int. Cl.[7] ..... E05F 5/06
(52) U.S. Cl. ..... 16/86 C; 16/863; 16/85 C
(58) Field of Search ..... 16/86 C, 86 B, 16/85; 292/262, 267, DIG. 61

(56) References Cited

U.S. PATENT DOCUMENTS

| | | | |
|---|---|---|---|
| 1,749,573 | A | 3/1930 | Earhart |
| 2,032,600 | A | 3/1936 | Smith |
| 2,290,331 | A | 7/1942 | Jacobs |
| 2,476,182 | A | 7/1949 | Davidson |
| 2,639,460 | A | 5/1953 | Schonitzer |
| 2,693,616 | A | 11/1954 | Cromwell et al. |
| 2,787,019 | A | 4/1957 | Galla |
| 2,860,369 | A | 11/1958 | Galla |
| 3,345,680 | A | 10/1967 | Slattery |
| 3,431,588 | A | 3/1969 | Frey |
| 3,434,179 | A | 3/1969 | Marchione |
| 3,550,185 | A | 12/1970 | Marchione |
| 3,729,772 | A | 5/1973 | Marchione |
| 3,837,040 | A | 9/1974 | Keller et al. |
| 3,905,064 | A | 9/1975 | Brockhaus |
| 3,969,789 | A | 7/1976 | Wize |
| 4,087,883 | A | 5/1978 | Amdal |
| 4,285,098 | A | 8/1981 | Hicks et al. |
| 4,322,103 | A | 3/1982 | Acton |
| 4,335,911 | A | 6/1982 | Taylor |

(List continued on next page.)

FOREIGN PATENT DOCUMENTS

| | | |
|---|---|---|
| CN | 614441 | 2/1961 |
| CN | 1 231 504 | 1/1988 |

(List continued on next page.)

*Primary Examiner*—Anthony Knight
*Assistant Examiner*—Mark Williams
(74) *Attorney, Agent, or Firm*—Pillsbury Winthrop LLP

(57) ABSTRACT

The present invention provides a door check device for installation between a motor vehicle body and a motor vehicle door that swings in opposing opening and closing directions relative to the vehicle body. The device comprises a first mounting structure that mounts on one of the vehicle door and the vehicle body and a second mounting structure that mounts on the other of the vehicle door and the vehicle body. The device also comprises first and second spaced apart cooperating structures and a link member having a detent provided on an intermediate portion thereof. The link member is received between the cooperating structures. The link member is carried by the first mounting structure and cooperating structures are carried by the second mounting structure such that the link member and the cooperating structures move relative to one another as the door is swung in the opposing opening and closing directions thereof. A spring structure is carried by the second mounting structure. The spring structure has first and second resilient torsionally deflectable biasing portions spaced apart and torsionally isolated from one another such that transmission of torsional stress between the torsionally deflectable portions is substantially prevented The biasing portions apply biasing forces to bias the cooperating structures into engagement with the elongated link member. Movement of the cooperating structures generally apart from one another individually torsionally deflects the biasing portions so as to individually increase torsional stress within the biasing portions and increase the biasing forces applied thereby.

15 Claims, 3 Drawing Sheets

U.S. PATENT DOCUMENTS

| | | | |
|---|---|---|---|
| 4,380,848 | A | 4/1983 | Guionie et al. |
| 4,536,918 | A | 8/1985 | Brockhaus |
| 4,588,220 | A | 5/1986 | Matsui et al. |
| 4,772,054 | A | 9/1988 | Schreiber |
| 4,997,221 | A | 3/1991 | Tolle et al. |
| 5,026,103 | A | 6/1991 | Tolle et al. |
| 5,048,150 | A | 9/1991 | Guerin |
| 5,074,010 | A | 12/1991 | Gignac et al. |
| 5,112,091 | A | 5/1992 | Kluting |
| 5,152,030 | A | 10/1992 | Cogo |
| 5,235,726 | A | 8/1993 | Geier et al. |
| 5,474,344 | A | 12/1995 | Lee |
| 5,524,324 | A | 6/1996 | Kunkel |
| 5,551,740 | A | 9/1996 | Lin et al. |
| 5,575,037 | A | 11/1996 | Tolle et al. |
| 5,675,869 | A | 10/1997 | Lotz |
| 5,791,017 | A | 8/1998 | Khiting |
| 5,794,309 | A | 8/1998 | Lotz |
| 5,862,570 | A | 1/1999 | Lezuch et al. |

FOREIGN PATENT DOCUMENTS

| | | | |
|---|---|---|---|
| DE | 1755713 | | 9/1971 |
| DE | 28 04 424 | | 8/1979 |
| DE | 43 25 550 | | 10/1994 |
| DE | 4447273 | * | 12/1994 |
| EP | 0 109 136 | | 3/1983 |
| EP | 0 111 380 | | 6/1984 |
| EP | 0 133 602 | | 2/1985 |
| EP | 0 525 268 | | 2/1993 |
| EP | 0 643 184 | | 3/1995 |
| EP | 0 835 976 | | 4/1998 |
| EP | 0 877 137 | | 11/1998 |
| EP | 0 899 403 | | 3/1999 |
| EP | 0 911 471 | | 4/1999 |
| EP | 0 915 223 | | 5/1999 |
| EP | 0 952 289 | | 10/1999 |
| FR | 872 692 | | 7/1939 |
| FR | 2 763 092 | | 11/1998 |
| FR | 2 764 627 | | 12/1998 |
| GB | 795867 | | 6/1958 |
| GB | 111380 | * | 3/1983 |
| GB | 109136 | * | 5/1984 |
| IT | 0 338 888 | | 4/1989 |
| WO | 99/51841 | | 10/1999 |
| WO | 99/53164 | | 10/1999 |
| WO | 00/15934 | | 3/2000 |
| WO | WO00/49257 | * | 8/2000 |

* cited by examiner

TORSION SPRING DOOR CHECK DEVICE

FIELD OF THE INVENTION

The present invention relates to a door check device for installation between a motor vehicle body and a motor vehicle door.

BACKGROUND OF THE INVENTION

A known door check device is produced by Ed. Scharwachter GmbH & Co. KG. in Europe and North America and is disclosed, for example, in U.S. Pat. No. 4,997,221 and in U.S. Pat. No. 5,026,103, the entire disclosures of both of which are incorporated herein by this reference. Referring to FIGS. 1–2 of the present application, such door checks conventionally utilize an "S" or "C" shaped torsion spring structure, generally indicated at 11, to bias a cylindrical roller 15 rotatably mounted to one of the end portions of the spring into engagement with a link member 21. The other end portion of the torsion spring structure is usually fixed. As the link member 21 moves relative to the roller 15 during door opening and closing movements, the roller rides up and over one of the protrusions 57. The torsion spring structure torsionally deflects at the center section 13 thereof to accommodate this movement. This torsional deflection is stored as energy and causes the spring structure to bias the roller 21 into the detent 17 defined between the protrusions 57 after the roller rides over the top of one of the protrusions 57. An analysis of the torsion spring structure 11 shows that most of the deflection energy built up in the spring structure 11 is generated within the center section 13 thereof. As a result, the cross sectional area must be sufficient enough to resist deflection as the roller is urged up the sloped surface of one of the protrusions 57 to maintain the roller 21 within the detent 17. This retains the door in its checked position until sufficient force is applied to ride the roller 21 up and over one of the protrusions 57 and out of detent 17, thus freeing the door for unchecked swinging movement. Further, the cross sectional area of the center section must be sufficient enough to withstand repeated torsional deflections over the life of the motor vehicle in which it is installed without fatiguing.

As a result of the overall efforts in the vehicle industry to reduce vehicle costs and weights, vehicle part manufacturers are continually trying to reduce the costs and weights of their parts. With respect to the present subject matter, there is a need in the art for a door check device that either performs comparably to the type described above but at a lower weight and cost or that performs better than the type described above without increased cost or weight.

SUMMARY OF THE INVENTION

It is therefore an object of the present invention to meet the above-described need. To achieve this object, the present invention provides a door check device for installation between a motor vehicle body and a motor vehicle door that swings in opposing opening and closing directions relative to the vehicle body. The device comprises a first mounting structure and a second mounting structure. The first mounting structure is constructed and arranged to be mounted on one of the vehicle door and the vehicle body and the second mounting structure is constructed and arranged to be mounted on the other of the vehicle door and the vehicle body such that the first and second mounting structures move relative to one another as the door is swung in the opposing opening and closing directions thereof relative to the vehicle body. The device also comprises first and second spaced apart cooperating structures and a link member having a detent provided on an intermediate portion thereof. In addition, the invention encompasses having a single pair of detents on opposing sides of the link member, two or more of such pairs of detents to provide for more than one checked position, or two or more detents on only one side of the link member to provide for more than one checked position. The link member is received between the cooperating structures with the cooperating structures engaging opposing sides of the link member. The link member is carried by the first mounting structure and cooperating structures are carried by the second mounting structure such that the link member and the cooperating structures move relative to one another as the door is swung in the opposing opening and closing directions thereof relative to the vehicle body.

A spring structure is carried by the second mounting structure. The spring structure has first and second resilient torsionally deflectable biasing portions spaced apart and torsionally isolated from one another such that transmission of torsional stress between the torsionally deflectable portions is substantially prevented. The first cooperating structure is connected to the first biasing portion and the second cooperating structure is connected to the second biasing portion such that (a) the biasing portions apply biasing forces to bias the two cooperating structures into engagement with opposing sides of the link member and (b) movement of the cooperating structures generally apart from one another individually torsionally deflects the first and second biasing portions so as to individually increase torsional stress within the biasing portions and thereby increase the respective biasing forces applied by the biasing portions.

The first and second cooperating structures are constructed and arranged such that when the vehicle door is swung to a checked position with respect to the vehicle body, one of the cooperating structures is received within the detent in a cooperating relationship to maintain the vehicle door at the checked position until a force is applied to the door sufficient to cause the link member to move relative to the cooperating structures so as to urge the cooperating structures generally apart from one another against the biasing of the torsionally deflectable biasing portions and move the one cooperating structure out of the detent.

Because the invention uses two torsionally deflectable biasing portions instead of only one as in the case of the prior art, comparing a prior art door check device and a door check device of the present invention wherein each device has the same diameter spring structure and detent(s) of the same geometry and depth, the device of the present invention will offer almost twice as much resistance to movement of the door from the checked position. Further, it would also be possible to design a door check device of the invention that offers the same amount of resistance to movement of the door panel with the same diameter spring structure by increasing the depth of the detent(s), thus distributing the force over two biasing portions so that the fatigue life of the spring structure is extended. Alternatively, it would be possible to produce a door check device capable of offering the same amount of resistance to movement of the door panel from the checked position as the prior art door check assemblies discussed above, but with a smaller and lighter spring structure.

These and other objects, features, and advantages of this invention will become apparent from the following detailed description when taken in conjunction with the accompanying drawings, which are a part of this disclosure and which illustrate, by way of example, the principles of this invention

BRIEF DESCRIPTION OF THE DRAWINGS

The accompanying drawings facilitate an understanding of the various embodiments of this invention. In such drawings.

DETAILED DESCRIPTION OF THE INVENTION

Figure 2:
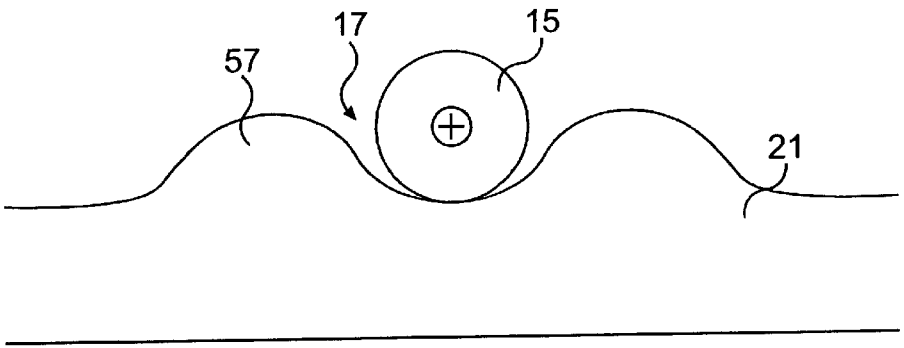
FIG. 2 (PRIOR ART)
FIG. 2 is a profile view showing a door check link member and a roller isolated from the remaining components of a typical door check device.
Figure 1:
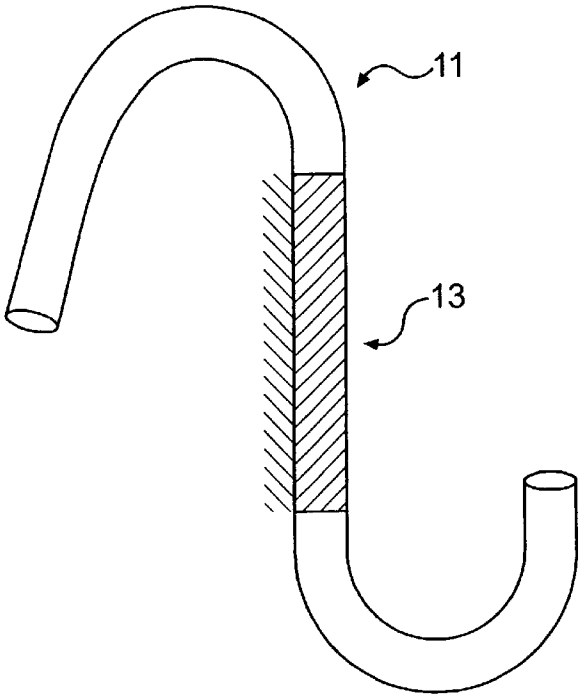
FIG. 1 (PRIOR ART)
FIG. 1 is a view of a torsion spring structure used in prior art door check devices.

FIGS. 3–6 show a door check device, generally indicated at 10, for installation between a motor vehicle body and a motor vehicle door that swings in opposing opening and closing directions relative to the vehicle body. The construction of the motor vehicle and the door thereof are not considered to be part of the present invention and thus will not be detailed herein. Instead, the present invention is concerned with the door check device 10.

The device 10 comprises a first mounting structure, generally indicated at 12, constructed and arranged to be mounted to the vehicle door and a second mounting structure, generally indicated at 16, constructed and arranged to be mounted on the vehicle body such that the first and second mounting structures 12, 16 move relative to one another as the door is swung in the opposing opening and closing directions thereof relative to the vehicle body.

The mounting structures 12, 16 are referred to as "first" and "second" mounting structures to reflect the fact that the door check device 10 may be installed either by mounting the first mounting structure 12 to the vehicle door and the second mounting structure 16 to the vehicle body or by mounting the first mounting structure 12 to the vehicle body and the second mounting structure 16 to the vehicle door. In the illustrated embodiment, the first mounting structure 12 is constructed and arranged to be mounted within the interior of the vehicle door and the second mounting structure 16 is constructed and arranged to be mounted to the vehicle body.

An elongated link member, generally indicated at 14, extends through the first mounting structure 12 and is pivotally connected to the second mounting structure 16. The elongated link member 14 has opposed first and second detents, shown generally at 18 and 19 respectively, formed on opposing sides of an intermediate portion thereof. The invention may also encompass more than one pair of detents 18, 19 to provide more than one checked position. The link member 14 is received between first and second cooperating structures 20, 22 with the cooperating structures 20, 22 engaging the opposing sides of the link member 14. The link member 14 moves with the second mounting structure 16 and the cooperating structures 20, 22 moves with the first mounting structure 12 such that the link member 14 and the cooperating structures 20, 22 move relative to one another as the vehicle door is swung in the opposing opening and closing directions thereof relative to the vehicle body.

The device 10 further comprises a generally triple U-shaped spring structure, generally indicated at 24, formed from a torsionally elastic metallic material, such as steel. The triple U-shaped spring structure 24 is carried by the first mounting structure 12. The triple U-shaped spring structure 24 is bent from an elongated piece of wire so as to have opposing first and second connecting legs, 26 and 28, which join a first U-shaped member 81 to a second U-shaped member 83 respectively via a connecting U-shaped member 23. The free leg of the first U-shaped member 81 provides a first cooperating structure mounting portion 80, and the free leg of the second U-shaped member 83 provides a second cooperating structure mounting portion 82. The first connecting leg 26 defines a first resilient torsionally deflectable biasing portion 30 and the second connecting leg 28 defines a second resilient torsionally deflectable biasing portion 32.

In the illustrated embodiment, the first cooperating structure 20 is a first cylindrical roller 34 rotatably mounted to the first cooperating structure mounting portion 80 via bushing 84 and the second cooperating structure 22 is a second cylindrical roller 36 rotatably mounted to the second cooperating structure mounting portion 82 via bushing 86. Bushings 84 and 86 may optionally be omitted to eliminate the part costs and assembly steps associated therewith. Each of the rollers 34, 36 has a bore formed axially therethrough with bushings 84 and 86 respectively mounted therethrough, and the cooperating structure mounting portions 80, 82 are inserted through these bores and bushings to mount the rollers 34, 36. Alternatively, the cooperating structures 20, 22 may be non-rolling sliding structures that frictionally slide along the opposing sides of the link member 14. In fact, the use of a cooperating structure separate from the spring structure may be eliminated and, instead, the portions of the spring structure 24 which is being referred to as mounting portions 80, 82 may be engaged directly with the opposing sides of the link member 14. In this arrangement, the mounting portions 80, 82 would instead be considered to be the first and second cooperating structures. For noise reduction purposes, in this arrangement the mounting portions 80, 82 would be coated with a low friction material.

Although in the illustrated embodiment the rollers 34, 36 are generally cylindrical, it should be understood that the present invention is not specifically limited to such rollers. For example, the cooperating structures 20, 22 may be spherical or ovoid rollers or any other structure suitable for cooperating with the link member 14.

The first mounting structure 12 is stamped from a piece of sheet metal and then folded or otherwise deformed in a conventional manner to provide the mounting structure 12 with a pair of generally parallel opposing retaining walls 75, 77 interconnected by a connecting metal wall 39, and two mounting flanges 71, 73.

Figure 3:
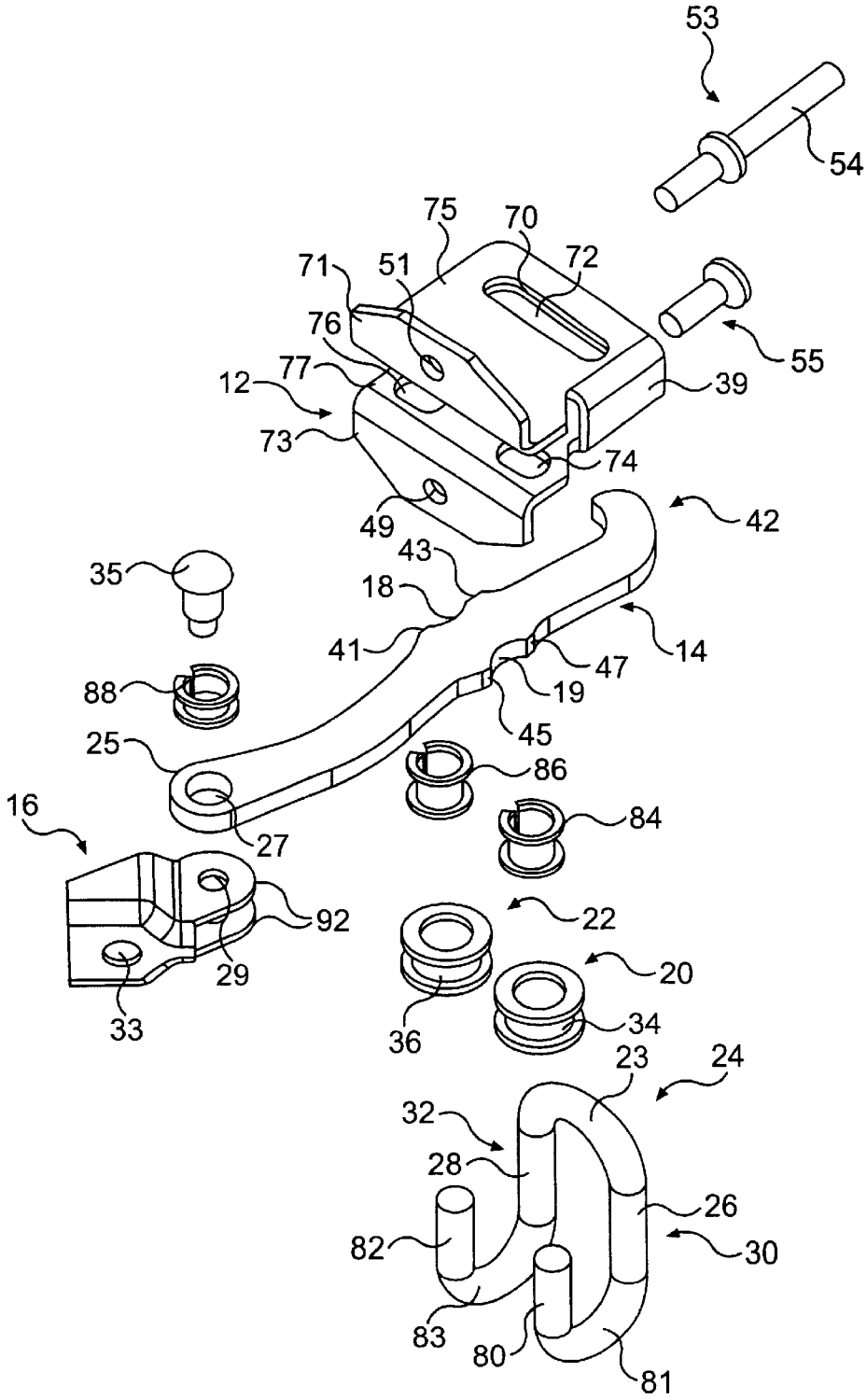
FIG. 3 is an exploded view of the door check device constructed in accordance with the principles of the present invention.

The first mounting structure 12 has aligned and spaced apart generally circular holes 49, 51 that are bored or stamped through the mounting flanges as shown in FIG. 3. The first mounting structure 12 is mounted within the interior of the vehicle door by use of mounting bolts 53, 55 inserted through these bored holes 49, 51 respectively. Alternatively, these holes may be omitted and the mounting structure 12 may be mounted by welding.

The second mounting structure 16 has two arms 92 with pivot pin receiving bores 29 used to pivotally connect therewith the link member 14 via pivot pin 35 and bushing 88. The second mounting structure also has a throughbore 33. The second mounting structure 16 and the circular end portion 25 of the link member 14 are pivotally connected by aligning bores 27, 29 with the link member between the two arms and inserting the pivot pin 35 therethrough. The second mounting structure 16 is mounted to the vehicle body by use of a bolt inserted through throughbore 33. Alternatively, the hole may be omitted and the mounting structure 16 may be mounted to the vehicle body by welding.

Figure 4:
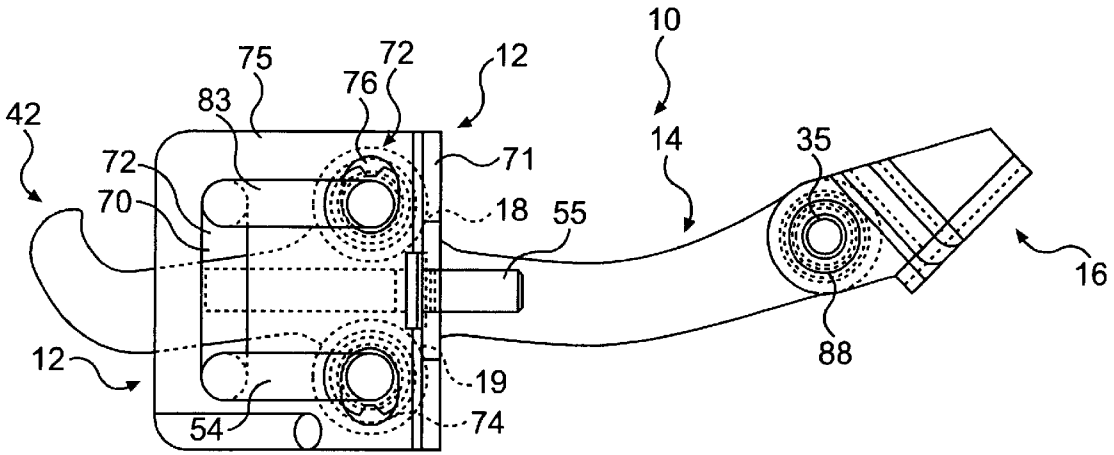
FIG. 4 is a profile side view of the door check device constructed in accordance with the principles of the present invention.
Figure 6:
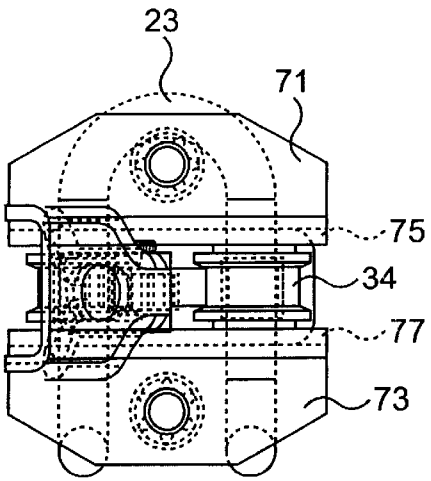
FIG. 6 is side view of the door check device of FIG. 5.
Figure 5:
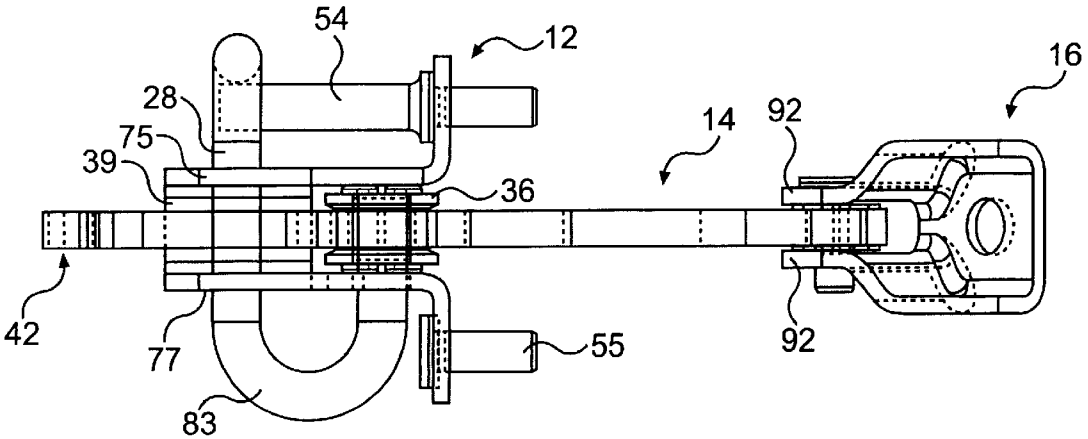
FIG. 5 is a bottom view of the door check device of FIG. 4.

The retaining walls 75, 77 each have a long elongated slot 70, 72 respectively, each having a width in the horizontal direction of FIG. 4 similar to the diameter of the spring structure 24 and a length in the vertical direction of FIG. 4 similar to the distance or spatial separation between the outside edges of the biasing portions 30, 32. Retaining wall 77 also has a spaced apart pair of short elongated slots 74, 76 each having a width in the horizontal direction of FIG. 4 at least slightly greater than the diameter of the spring structure 24, and a length in the vertical direction of FIG. 4 somewhat greater than the diameter of the spring structure 24. The folding of the sheet metal piece defining the mounting structure 12 causes the slots to be positioned in alignment with one another.

The triple U-shaped structure 24 is mounted to the mounting structure 12 by inserting the connecting U-shaped member 23 through the aligned long elongated slots 70, 72 such that biasing portions 30, 32 extend through the long elongated slots 70, 72, and cooperating structure mounting portions 80, 82 extends through short elongated slots 74, 76, respectively. During this insertion, the rollers 34, 36 (with the bushings 84, 86 therein) are positioned between retaining walls 75, 77 with the bores thereof aligned with the appropriate short elongated slot so that the cooperating structure mounting portions 80, 82 are inserted through the bores (and the bushing bores) during mounting. The triple U-shaped structure 24 is restrained from separating from the first mounting structure 12 by restraining rod 54, which is constructed as an extension of mounting bolt 53. Specifically, as can best be seen in FIG. 5, restraining rod 54 extends into the bight of connecting U-shaped member 23 so that the triple U-shaped structure 24 is prevented from being withdrawn from aligned long elongated slots 70, 72 (in the downward direction of FIG. 5).

Because the lengths of the slots 74, 76 are somewhat greater than the diameter of the cooperating structure mounting portions 80, 82, the cooperating structure mounting portions 80, 82 will be allowed to move towards and away from one another within the slots 74, 76 thus permitting movement of the rollers 34, 36 in directions towards or away from the link member 14. Also, because the width of the slots 74, 76 is at least slightly greater than the diameter of the portions 80, 82, the portions 80, 82 will not rub against the edges of the slots 74, 76 during movement of the rollers 34, 36 toward and away from one another. This reduces the potential for noise created by such rubbing action.

The first and second biasing portions 30, 32 are normally stressed so as to bias the first and second cooperating structures 20, 22, via the first and second U-shaped members 81, 83, into engagement with the link member 14. During movement of the first and second cooperating structures 20, 22 in a direction away from the link member 14, which occurs when the cooperating structures 20, 22, ride up the protrusions 41, 43 on link member 14, the mounting portions 80, 82 move apart from one another so as to individually torsionally deflect the biasing portions 30, 32 thereby increasing torsional stress within each biasing portion 30, 32 and thus increasing the respective biasing forces applied thereby (and hence resistance against door movement). Deflection may also occur in other areas, such as the bights of U-shaped members 81, and 83, but the majority of the resistance to deflection is provided by biasing portions 30, 32.

Torsional stresses communicated to the first biasing portion, 30 by the first U-shaped member 81 are substantially isolated from the second biasing portion 32 because connecting U-shaped member 23 is restrained from moving in response to torques applied thereto by the first biasing portion 30. This restraint is provided by the tight tolerance between the width of the long elongated slots 70, 72 and the diameter of the spring structure 24 at the connecting U-shaped member. As can be fully appreciated from FIGS. 3 and 4, this arrangement is bilaterally symmetric with respect to the triple U-shaped structure 24. Therefore, torques communicated to the second biasing portion 32 via the second U-shaped member 83 are likewise isolated from the first biasing portion 30. Thus, it can be said that the first and second biasing portions are torsionally isolated from one another such that transmission of torsional stress between the biasing portions 30, 32 is substantially prevented. By the term "substantially prevented," it is meant that any transmission of torsional stress between the biasing portions 30, 32 is at most negligible. The term "substantially" is used to cover designs that embody the principles of the present invention, but in which negligible amounts of torsional stress are transmitted due to design imperfections or the like.

The present invention is not intended to be limited to the use of a plurality of slots for mounting the spring structure 24. The illustrated embodiment is a preferred embodiment and should not be considered as limiting. In contrast, the invention is intended to encompass any way of mounting the spring structure 24 to the second mounting structure 12.

As the link member 14 is moved in the longitudinal direction thereof due to vehicle door opening and closing movements, the rollers 34, 36 roll along the opposing sides of the link member 14 in a normal generally parallel relation. The link member 14, however, has a pair of detents 18, 19 formed by two pairs of spaced apart rounded protrusions 41, 43, 45, and 47. Continued movement of the link member 14 relative to the mounting structure 12 causes the rollers 34, 36 to contact protrusions 41, 45 and then roll up or ride over these protrusions 41, 45. As the rollers 34, 36 roll up the protrusions 41, 45, the riding movement of the rollers 34, 36 in a direction away from the link member 14 individually torsionally deflects the biasing portions 30, 32 in the manner discussed above. As the deflection of the biasing portions 30, 32 increases, the resistance they provide to door movement likewise increases. As the rollers 34, 36 pass over the apexes of the protrusions 41, 45 the increased biasing force in biasing portions 30, 32 resulting from the torsional deflection biases the rollers 34, 36 into engagement with the link member 14 in a cooperating relation with the detents 18, 19. This is the checked position.

The rollers 34, 36 are constructed and arranged such that when the vehicle door is swung to the checked position with respect to the vehicle body with the rollers 34, 36 received within the first and second detents 18, 19, the rollers 34, 36 and the detents 18, 19 cooperate to maintain the vehicle door at this checked position until a force is applied to the door sufficient to cause the link member 14 to move relative to the rollers 34, 36 so as to urge the rollers 34, 36 generally apart from one another against the biasing of the first and second biasing portions 30, 32, thus moving the rollers 34, 36 out of their respective detents 18, 19. Specifically, the device 10 functions to maintain the checked position until the force applied to the vehicle door is sufficient to move the link member 14 relative to the rollers 34, 36 so as to cause the rollers to ride up one of the opposed sets of protrusions 41, 45 and over the apexes thereof against the resistance of the biasing portions 30, 32. The force required to cause the rollers 34, 36 to ride up one of the opposed sets of protrusions 41, 45 is determined by the spring constant, the cross-sectional area of the biasing portions 30, 32, and the heights and geometries of the protrusions 41, 45.

The invention is not limited to having only a pair or multiple pairs of opposing detents on opposite sides of the link member 14. Specifically, the invention contemplates having a single detent on only one side of the link member 14. In this arrangement, even though only one detent is used, both biasing portions 30, 32 will still be deflected as one of the rollers 34, 36 rides up and over the single detent because the biasing portion for the roller on the side without the detent will deflect under the reaction force created by the biasing portion for the side with the detent. Likewise, the link member 14 may be provided with a plurality of detents on only one side thereof to provide for a plurality of checked positions.

The invention is not limited to mounting the cooperating structures 20, 22 on the spring structure 24 as is illustrated and described. Any way of connecting the cooperating structures 20, 22 to the biasing portions 30, 32 such that movement of the cooperating structures 20, 22 torsionally deflects the biasing portions 30, 32 is contemplated by the invention.

The link member 14 further comprises a stopping portion, generally indicated at 42, provided at one end portion thereat opposite the second mounting structure 16. The stopping portion 42 is constructed and arranged to prevent the link member 14 from being withdrawn from between the first and second cooperating structures 20, 22 in a direction away from the end portion. Also, when the device 10 is installed and the vehicle door is swung to its fully open position, the stopping portion 42 will prevent the vehicle door from moving beyond the fully open position thereof. Usually, this is accomplished in conjunction with a stop provided on the door's hinge with the hinge stop absorbing approximately 50% of the door's force during stopping and the stopping portion 42 absorbing approximately the other 50%.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A door check device for installation between a motor vehicle body and a motor vehicle door that swings in opposing opening and closing directions relative to the vehicle body, said door check device comprising:

a first mounting structure;

a second mounting structure, said first mounting structure being constructed and arranged to be mounted on one of the vehicle door and the vehicle body and said second mounting structure being constructed and arranged to be mounted on the other of the vehicle door and the vehicle body such that said first and second mounting structures move relative to one another as the door is swung in the opposing opening and closing directions thereof relative to the vehicle body;

an elongated link member having a detent provided on an intermediate portion thereof;

first and second spaced apart cooperating structures extending essentially parallel to one another and essentially perpendicular to a longitudinal extent of said link member, said link member being received between said cooperating structures with said cooperating structures engaging opposing sides of said link member;

said link member being carried by said first mounting structure and said cooperating structures being carried by said second mounting structure such that said link member and said cooperating structures move relative to one another as the door is swung in the opposing opening and closing directions thereof relative to the vehicle body;

a spring structure having first and second resilient torsionally deflectable biasing portions spaced apart and torsionally isolated from one another such that transmission of torsional stress between said biasing portions is substantially prevented, said biasing portions being oriented essentially parallel to said first and second cooperating structures;

said first cooperating structure being connected to said first torsionally deflectable biasing portion and said second cooperating structure being connected to said second torsionally deflectable biasing portion such that (a) said first resilient torsionally deflectable biasing portion applies a biasing force to bias said first cooperating structure into engagement with one opposing side of said link member and said second resilient torsionally deflectable biasing portion applies a biasing force to bias said second cooperating structure into engagement with the other opposing side of said link member and (b) movement of said first and second cooperating structures generally apart from one another individually torsionally deflects said first and second biasing portions so as to individually increase torsional stress within said biasing portions and thereby increase the respective biasing forces applied by said biasing portions;

said first and second cooperating structures being constructed and arranged such that, when the vehicle door is swung to a checked position with respect to the vehicle body, one of said first and second cooperating structures is received within said detent in a cooperating relationship to maintain the vehicle door at the checked position until a force is applied to the door sufficient to cause said link member to move relative to said cooperating structures so as to urge said cooperating structures generally apart from one another against the biasing of said torsionally deflectable biasing portions and move said one cooperating structure out of said detent.

2. A door check device according to claim 1, wherein said spring structure has first and second mounting portions connected to said first and second torsionally deflectable biasing portions, respectively, and wherein said first and second cooperating structures are formed separately from said spring structure and mounted on said first and second mounting portions, respectively.

3. A door check device according to claim 2, wherein said link member has another detent provided on said intermediate portion of said link member opposite the aforesaid detent.

4. A door check device according to claim 1, wherein first cooperating structure is a first cylindrical roller rotatably mounted to said first mounting portion and wherein said second cooperating structure is a second cylindrical roller rotatably mounted to said second mounting portion.

5. A door check device according to claim 3, wherein said detents are directly opposite one another.

6. A door check device according to claim 1, wherein said first mounting structure is a body mounting bracket constructed and arranged to be mounted to the vehicle body and wherein said second mounting structure is a door mounting bracket constructed and arranged to be mounted to the vehicle door.

7. A door check device according to claim 1, wherein said first mounting structure is a door mounting bracket constructed and arranged to be mounted to the vehicle door and wherein said second mounting structure is a body mounting bracket constructed and arranged to be mounted to the vehicle body.

8. A door check device according to claim 1, wherein said spring structure is made of a metallic material.

9. A door check device according to claim 8, wherein said spring structure is formed from an elongated wire made from said metallic material.

10. A door check device according to claim 9, wherein said metallic material is steel.

11. A door check device according to claim 9, wherein said second mounting structure has a plurality of apertures that each receive portions of said spring structure in closely spaced relation so as to mount said spring structure to said second mounting structure.

12. A door check device according to claim 11, wherein said plurality of apertures includes: (a) a relatively long elongated slot of a length similar to the spatial separation between outside surfaces of said first and second biasing portions and a width similar to the diameter of said elongated wire, and (b) first and second spaced apart relatively short elongated slots of a length sufficient to accommodate movement of said wire as said cooperating structures are moved apart from one another and of a width sufficient to prevent said wire, said biasing portions being received in said relatively long slot and said mounting portions being received in said relatively short slots from contacting the edge of said short slots as said cooperating structures are moved apart from one another.

13. A door check device according to claim 12, wherein said second mounting structure has two spaced apart parallel plates, one of said plates having said relatively long elongated slot and said first and second spaced apart relatively short elongated slots formed therein.

14. A door check device according to claim 13, wherein the other parallel plate also has a relatively long slot similar to and aligned with the aforesaid long slot and wherein said first and second biasing portions are also received in the relatively long slot of said the other parallel plate.

15. A door check device according to claim 1, wherein said link member further comprises a stopping portion mounted at an end portion thereof opposite said first mounting structure, said stopping portion being constructed and arranged to prevent said link member from being withdrawn from between said cooperating structures in a direction away from said end portion.

* * * * *